United States Patent [19]

Collura et al.

[11] 4,285,185

[45] Aug. 25, 1981

[54] ARTICLE CARRIER FEEDING AND CONTROL APPARATUS

[75] Inventors: Peter C. Collura, Los Altos; Chester J. Pierce, Jr., Pioneer, both of Calif.

[73] Assignee: Certipak Corporation, Greenwich, Conn.

[21] Appl. No.: 70,668

[22] Filed: Aug. 29, 1979

[51] Int. Cl.[3] ..... B65B 21/24; B65B 27/04

[52] U.S. Cl. ..... 53/48

[58] Field of Search ..... 53/48, 203, 590

[56] References Cited

U.S. PATENT DOCUMENTS

| | | | |
|---|---|---|---|
| 2,809,484 | 11/1957 | Gentry | 53/48 X |
| 2,900,772 | 8/1959 | Chidsey, Jr. et al. | 53/48 |
| 3,303,631 | 2/1967 | Ganz | 53/48 |
| 3,415,033 | 12/1968 | Perry et al. | 53/48 X |
| 3,430,413 | 3/1969 | Wood | 53/48 |
| 3,474,590 | 10/1969 | Ganz | 53/48 |
| 3,540,185 | 11/1970 | Gentry | 53/48 |
| 3,572,003 | 3/1971 | Perry et al. | 53/48 X |
| 3,701,231 | 10/1972 | Standley | 53/48 |
| 3,815,320 | 6/1974 | Ganz | 53/48 |

*Primary Examiner*—Horace M. Culver

*Attorney, Agent, or Firm*—Lowe, King, Price & Becker

[57] ABSTRACT

Apparatus for continuously feeding and controlling wraparound carrier for packaging a plurality of articles or containers is disclosed. The carriers are of the type having at least two draw-down and feed openings, one opening formed on each side thereof. Each carrier is initially partially wrapped about a plurality of containers. The carrier and container assemblies move along a guide track to the entrance of the carton draw-down (tightening) conveyor line of the present invention. The conveyor line comprises a pair of continuously moving timing chains having a plurality of draw-down lugs pivotally attached to and spaced apart along the chain. Each lug includes a tongue portion adapted for insertion through the openings to feed and to draw down the side walls, and also to control the positioning and movement of the containers. As the partially assembled carrier and containers enter between the moving chains, a cam follower portion of the lugs contact the camming rails, causing the lugs to sequentially pivot downwardly and into contact with the openings formed in the carrier. The carrier is moved along the conveyor line with the lugs engaging the containers through the carrier apertures for positive control. Downward pressure is applied by the lugs to the carrier, causing the carrier to be pulled down and tightened about the containers. The lugs are pivoted out of contact with the carrier as the carrier exits the conveyor line to complete the assembly process.

14 Claims, 6 Drawing Figures

ARTICLE CARRIER FEEDING AND CONTROL APPARATUS

TECHNICAL FIELD

The invention relates to the field of packaging apparatus and, more particularly, to apparatus for continuously feeding and assembling wraparound carriers to a plurality of containers including carrier draw-down and container positioning means.

BACKGROUND ART

Many techniques have been developed for packaging a plurality of containers, such as bottles, cans or the like. Carriers for such containers can take many shapes depending upon the size and nature of the containers to be packaged.

One well-known type of carrier for such containers is what is known as a "wraparound" carrier. Such a carrier is formed from heavy paperboard stock, or the like, and includes a top panel, a pair of side wall panels hinged to the top panel and a pair of overlapping or interlocking base panels attached to each side panel.

Packaging of containers with a wraparound carrier is normally accomplished by providing what are known as draw-down openings formed in the side walls of the carrier. A plurality of containers are initially aligned with one another in a desired formation and the wraparound carrier is partially assembled with the top and side wall panels in contact with the containers. The partially assembled carrier and container assembly is conveyed through a draw-down conveyor section where draw-down arms engage the apertures formed in the side walls of the carrier to tighten the carrier about the containers. Subsequently, the base panels are secured together, either by interlocking tongue and slit portions formed on the bottom panels or by adhesive applied to the base panels depending upon the type of carrier used. The completed carrier and multiple container assembly is then ejected from the draw-down section for subsequent shipping and/or storage.

While prior art wraparound packaging apparatus can tighten and secure such carriers, such apparatus does not accurately locate, position or control the containers within the carrier during assembly. It is well-known that when wraparound carriers are rapidly applied to a plurality of containers in a continuous line, such containers tend to "shingle out" and become misaligned within the completed carrier. This is due to the vibration of the packaging machinery, the tendency of the containers to bounce and the minor differences in speed and momentum of the individual containers and paperboard carrier. If adjacent containers come into contact with one another, the chances of breakage of the containers are increased, especially if they are made of a brittle material such as glass.

In other types of prior art wraparound packaging apparatus attempts have been made to overcome these difficulties, but in these cases speed is severely limited in that the tightening and securing operation is performed while the carrier and container assembly is held stationary at a draw-down station. Thus, the assembly speed of the carrier about the containers is limited by the operating speed of the draw-down fingers and the sealing means. In addition, separate transporting or conveying apparatus is needed to transfer the completed carton carrier from the draw-down station.

Thus there is the need for wraparound carrier assembly apparatus which operates rapidly and continuously and provides positive feed, position control of adjacent containers and tightening of the carrier about the containers.

OBJECTS OF THE INVENTION

It is therefore an object of the invention to provide apparatus for continuously and rapidly feeding and assembling a wraparound carrier to a plurality of containers.

It is another object of the invention to provide carrier assembly apparatus including means for simultaneously tightening a wraparound carrier about a plurality of containers and accurately positioning the containers within the carrier.

It is a further object of the invention to provide apparatus for assembling a wraparound carrier whereby the carrier can be assembled about a plurality of containers while the containers move in a continuous line.

DISCLOSURE OF INVENTION

These and other objects are achieved by the apparatus of the present invention wherein there is provided apparatus for tightening and securing a wraparound carrier about a plurality of containers or the like. The apparatus includes a draw-down conveyor line having a pair of movable chains arranged on opposite sides of a guide track for positively conveying the carrier and also positioning the containers. A plurality of spring-biased draw-down lugs are pivotally attached to and spaced along the chains, each lug including a tongue portion adapted for insertion into at least a pair of openings formed in the opposite side walls of the carrier. Pusher arms are mounted on the movable chains for engaging the trailing end and spacing the carrier and container assemblies apart. This arrangement accurately aligns the openings of the carriers with the pivoting lugs as a carrier enters the conveyor section between the movable chains.

A pair of camming rails are disposed on opposite sides of the guide track at the entrance to the draw-down conveyor section. The cams cooperate with a vertical cam follower surface of the lugs to sequentially pivot pairs of lugs downwardly into contact with the tapered sides of the openings of the carrier and to thus apply steady forward and downward pressure thereto. The carrier is assisted in moving through the conveyor section by the lugs also engaging the containers through the carrier apertures. Downward pressure applied to the lugs by the camming rails causes the lugs to engage the sides of the openings adjacent the bottom so that the carrier is pulled down and tightened about the containers. The inwardly projecting tongues of the lugs advantageously serve to accurately position and align the containers preferably in non-contacting arrangement within the carrier. The carrier is then secured together along the base panels. The lugs are spring biased to pivot out of contact with the carrier as the carrier exits the conveyor line to complete the assembly process.

The apparatus of the present invention thus has the advantage that carrier draw-down (tightening) is performed while the carrier and container assemblies are assisted in moving in a continuous stream along the guide track between the continuously moving chains. There is no tendency for the rear of the carrier to buckle or sag open due to the increased frictional force on the front of the carrier, as has sometimes been experienced in the past without positive feed, draw-down and container control. To perform the control function, vertical faces of the tongue portion of each lug are adapted to engage the vertical side walls of containers disposed within a carrier when the tongue portion projects through the openings formed in the side walls of the carrier. In this manner, the containers are accurately spaced apart and prevented from undesirable movement within a carrier while the carrier is being tightened and secured about a group of containers.

The apparatus of the present invention enables a wraparound carrier to be applied rapidly and continuously to an assembled moving stream of containers while providing positive control and positioning of the containers as they are secured within the carrier.

BRIEF DESCRIPTION OF THE DRAWING FIGURES

These and other objects, features and advantages of the present invention are described in considerable detail in the following description of the preferred embodiment, taken in conjunction with the accompanying drawing figures wherein.

BEST MODE OF CARRYING OUT THE INVENTION

Figure 1:
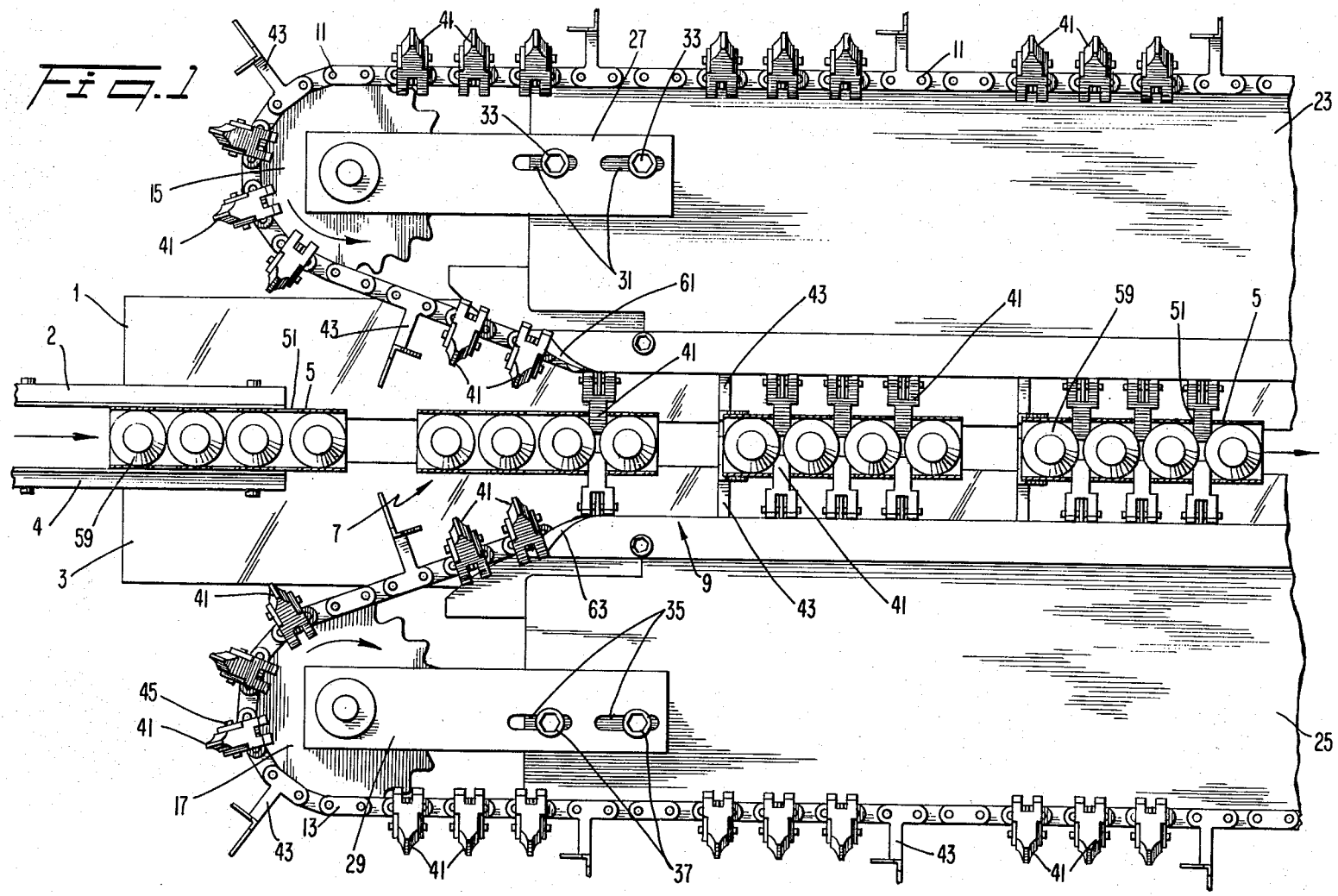
FIG. 1 is a top view of an entry portion of the packaging apparatus of the present invention.
Figure 2:
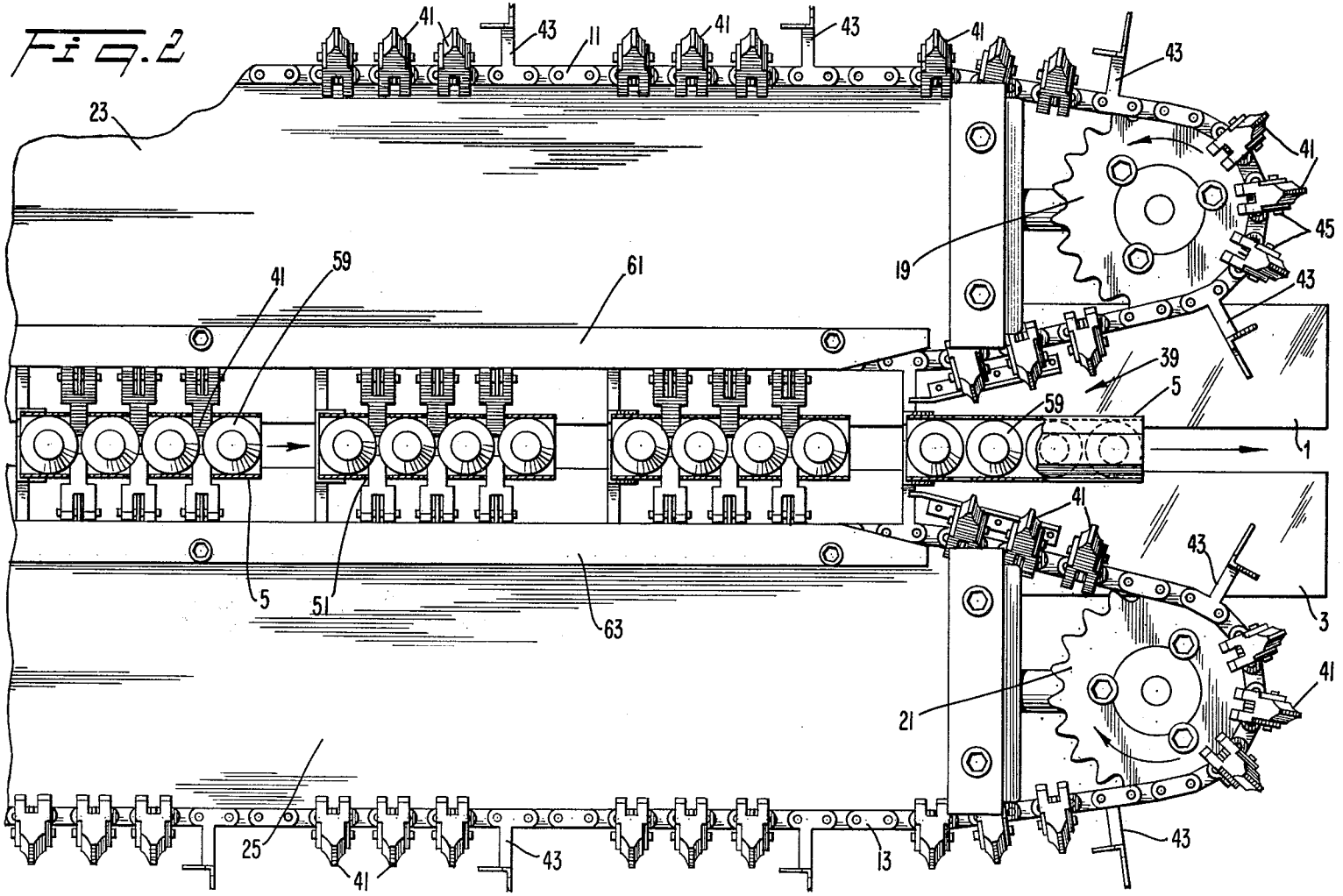
FIG. 2 is a top view of an exit portion of the apparatus shown in FIG. 1.

Referring to FIGS. 1 and 2, the packaging apparatus of the present invention includes a pair of track members 1 and 3 and vertical entering guides 2 and 4 for guiding a plurality of carrier and container assemblies 5 into the entrance 7 of conveyor and draw-down apparatus 9. Each carrier is initially partially wrapped about a group of containers before entering conveyor line 9. Draw-down conveyor line 9 includes a pair of identical endless loop chains 11 and 13 having portions disposed for movement adjacent to guide tracks 1 and 3. Each chain 11, 13 is of the flexible link type and engages respective entrance and exit gears 15, 17, and 19, 21.

The chains are continuously driven in the direction indicated by the arrows by drive means (not shown) connected to gears 19 and 21. Gears 15, 19 and 17, 21 are attached to respective elongated frame members 23 and 25. The edges of the frame members 23 and 25 also serve as guides for endless chains 11 and 13, respectively. The tension applied to chains 11 and 13 is adjusted by adjusting the spacing between gears 15, 19 and 17, 21. Adjustment of the tension is provided by movement of entrance gear supports 27 and 29. One end of support 27 is attached to gear 15 with its other end including a pair of slots 31 slidably engaging fastening bolts 33. Gear 17 is similarly adjusted by slots 35 provided on arm 29 which engage fastening bolts 37.

Gears 15, 17 and 19, 21 and chains 11 and 13 are arranged such that the chains converge toward entrance 7 of conveyor line 9 and diverge at exit 39 of the conveyor line.

Each chain 11, 13 includes a plurality of identical lugs 41 pivotally attached to and spaced apart along the chains. Lugs 41 are arranged along the movable groups corresponding to the spacing of openings formed in the side walls of a container carrier (see FIG. 5). The groups of lugs on each chain 11, 13 are arranged to be aligned directly opposite one another when moving along conveyor line 9. A pusher arm 43 is attached to chains 11 and 13 at the trailing end of each group of lugs 41. Pusher arms 43 are L-shaped for engaging the trailing (left-hand in FIGS. 1 and 2) end of the carrier and container assemblies 5. Pusher arms 43 advantageously assist in aligning the carton and container assemblies so that the draw-down openings will be disposed opposite the corresponding group of lugs 41.

Figure 3:
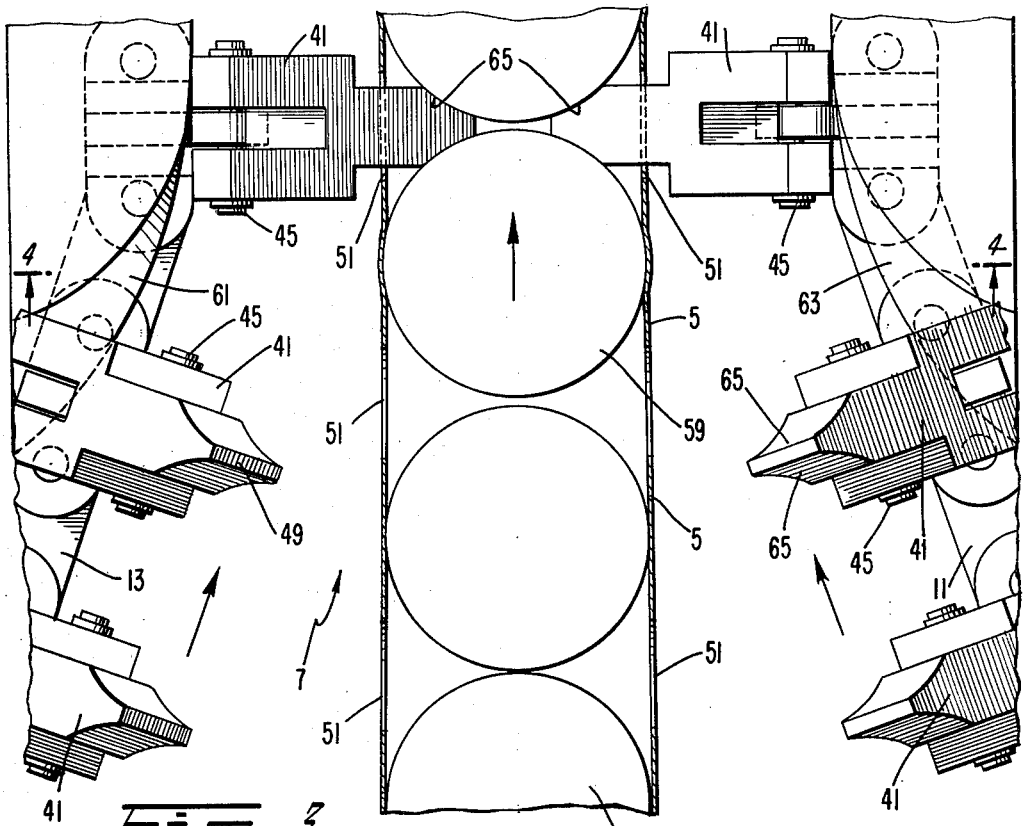
FIG. 3 is a detail top view of a portion of FIG. 1 showing the relationship of a container carrier to the carrier draw-down apparatus during initiation of the operation.
Figure 5:
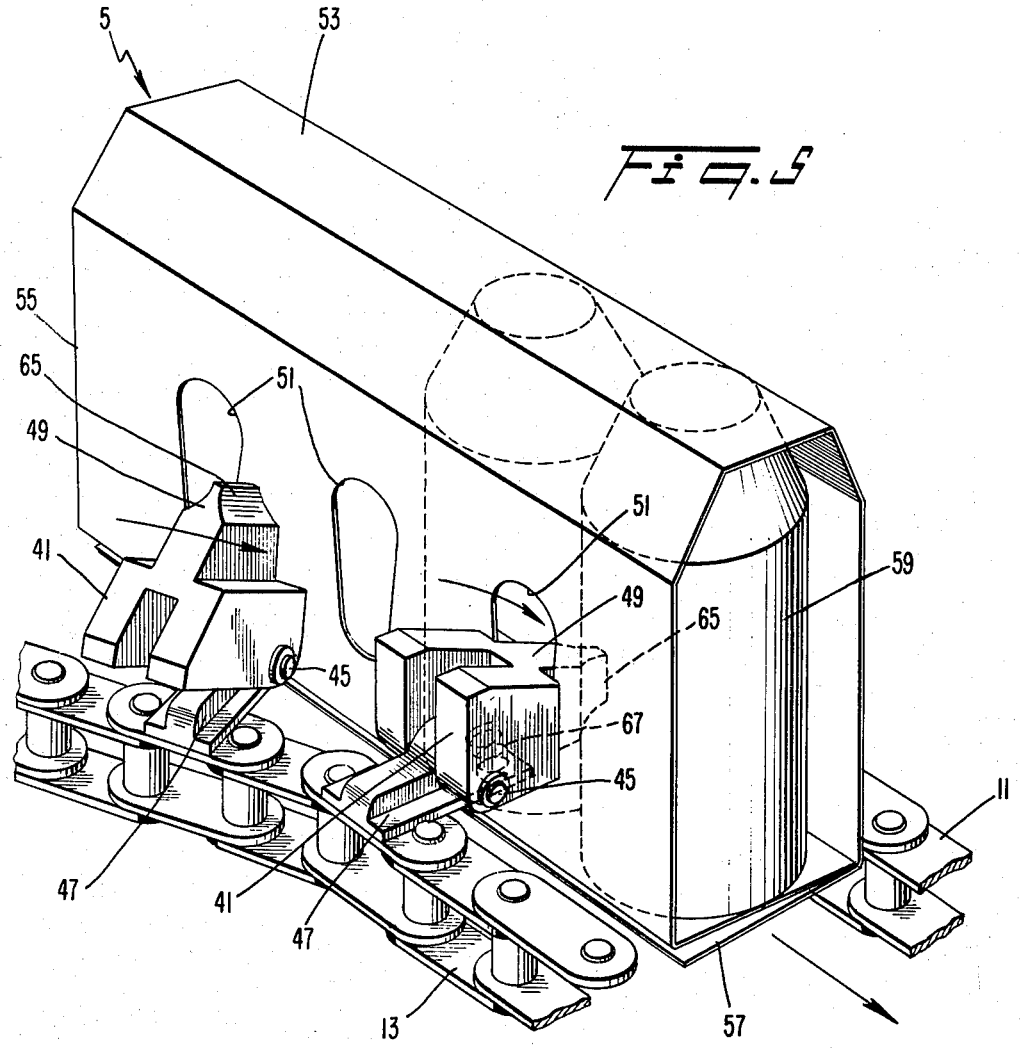
FIG. 5 is a detailed perspective view showing the relationship of the container carrier and the enclosed containers to the pivoting draw-down and positioning lugs.

As shown in FIGS. 3 and 5, each lug 41 has a bifurcated body pivotally attached by a rod or axle 45 to an offset support plate 47 which, in turn, is attached to the movable chains. Each lug 41 further includes an extension or tongue portion 49 adapted to fit through openings 51 of container carrier assembly 5. Tongue portion 49 includes coutoured vertical faces 65 which are adapted to contact and mate with the vertical sidewalls of adjacent containers disposed within carrier 5. Vertical faces 65 serve to controllably space and align containers 59 within carrier 5.

Figure 4:
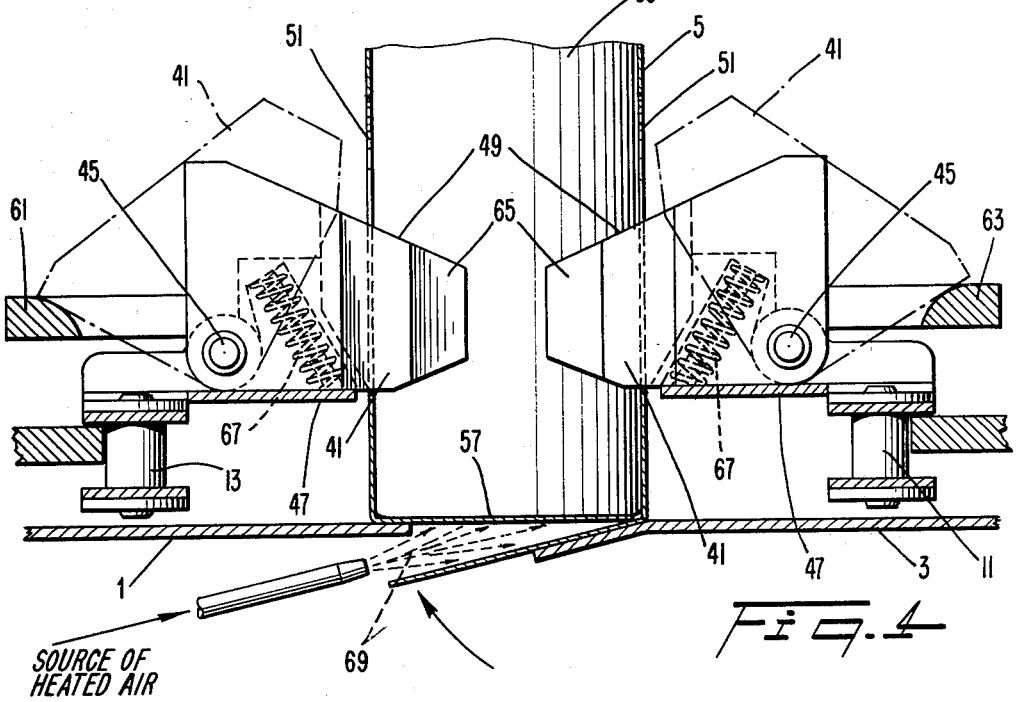
FIG. 4 is a sectional view taken along lines 4—4 of FIG. 3.

Each lug 41 includes a spring 67 (FIG. 4) disposed between offset support plate 47 and the bifurcated portion of lug 41. Spring 67 serves to normally lift or bias lug 41 into a raised position, as shown in dashed lines in FIG. 4.

Container carrier 5 is of the wraparound type formed from die-cut paperboard stock or the like. Carrier 5 includes a top panel 53, a pair of side wall panels 55 hinged to the top panel, and a pair of base panels or bottom flaps 57 hingedly attached to wall panels 55. Carrier 5 is designed to be wrapped and secured around a group of containers 59 of any desired shape and contour disposed within carrier 5.

At least a pair of opposed product control and draw-down openings 51 are formed on opposite side walls 55 of each carrier 5. Openings 51 are positioned so as to be between the containers 59. Openings 51 can take various shapes, with the tapered keyhole shape shown in FIG. 5 being preferred for use with lugs 41. The number of pairs of openings 51 is normally one less than the number of containers in a row disposed in carrier 5. While carrier 5 is shown as accommodating a single row of four containers, it is understood that various other container arrangements are contemplated by the present invention. For instance, multiple row container groupings and carriers (e.g., six-pack or $2\times3$ container groups) can be accommodated by suitable modification of conveyor line 9.

A pair of cams or camming rails 61 and 63 are attached to respective frames 23 and 25 along conveyor line 9. As shown in FIGS. 1 and 3, camming rails 61 and 63 each take the form of a rail starting horizontally at the upstream end of entrance 7 of conveyor line 9. The camming rails converge toward one another along complementary arcuate curves at entrance 7 of conveyor line 9. Camming rails 61 and 63 are disposed parallel to one another along the remaining length of conveyor line 9 and diverge at the exit 39 (FIG.2).

Chains 11 and 13 are arranged for movement past camming rails 61 and 63, respectively, as shown in FIG. 3. The bifurcated rear edge of lugs 41 contact camming rails 61 and 63 at the point where the rails 61 and 63 begin arcuately converging toward one another at the entrance of conveyor line 9. As lugs 41 proceed into conveyor line 9, pairs of lugs 41 are pivoted downwardly against spring bias provided by springs 67 into the operative positioning and draw-down position shown by solid lines in FIG. 4. This happens through contact of the bifurcated surfaces of lugs 41 with camming rails 61 and 63.

When the first pair of lugs 41 are so pivoted, the tongue portions 49 enter and engage a first pair of openings 51 formed in container carrier 5 as shown in FIGS. 1, 3 and 5. Vertical faces 65 of tongue portions 49 of lugs 41 fit smoothly against the vertical surfaces of adjacent containers 59 to space and position the containers in a controlled manner.

The first (downstream) pair of lugs engaging carrier 5 draws the carrier and containers smoothly into conveyor line 9. Subsequent pairs of lugs 41 are progressively and sequentially pivoted into contact with additional openings 51 formed in carrier 5 as the carrier proceeds along the conveyor line 9. Pusher arms 43 engage the tailing end of the container carrier assembly 5 (FIGS. 1 and 2). Pusher arms 43 aid in conveying the carrier assembly along the conveyor line and prevent the last inline container within each container from working out of the carrier during subsequent carrier draw-down and securing operations.

One or more pairs of the downwardly pivoted lugs 41 apply a constant downward pressure to the tapered sides of the openings 51 of the carrier side walls causing the carrier to be drawn down and tightened securely about containers 59. Vertical faces 65 of each pair of opposing lugs 41 accurately locate and position adjacent containers 59 relative to one another and to carrier 5. As the carrier 5 is being tightened about all of the containers 59, base panels 57 of carrier 5 may be sealed together by a stream of hot air 69 directed toward heat activated adhesive previously applied to the facing surfaces of base panels 57. Of course, other means for securing together base panels 57 could be used. For instance, panels 57 could include complementary interlocking tongue and slit portions as is well-known in the art.

Figure 6:
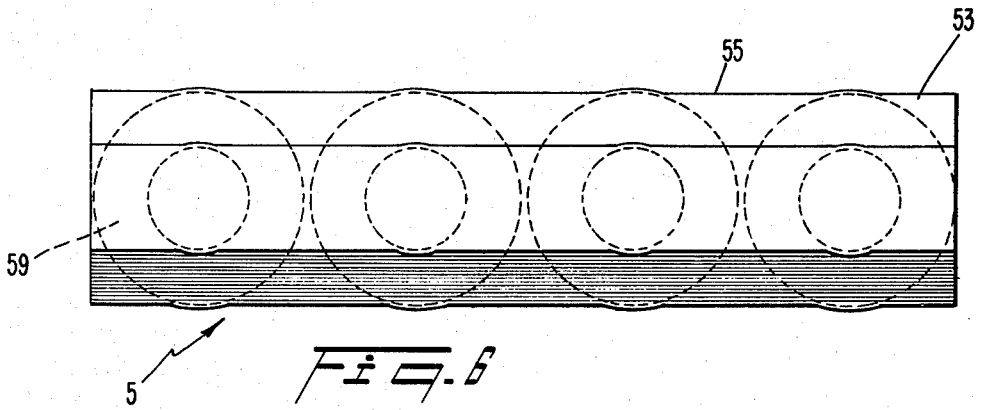
FIG. 6 is a top view of an article carrier for use with the apparatus of the present invention shown completely assembled about a group of containers.

Upon completion of the draw-down and securing operations, a completed container carrier assembly 5 (FIG. 6) is conveyed to exit area 39 of conveyor line 9. At exit 39, chains 11 and 13 and cams 61 and 63 diverge away from the completed carrier. At this point lugs 41 no longer contact cams 61 and 63. The action of the lug springs 67 causes tongue portion 49 of each lug 41 to be disengaged from contact with containers 59 and carrier 5. After disengagement from carrier 5, tongues 49 and lugs 41 remain in a normally vertical or raised position with respect to guide tracks 1 and 3, as shown in dashed lines in FIG. 4. Lugs 41 remain in this position until returned by the cams 61, 63 at the entrance 7 of conveyor line 9.

It is contemplated that with any desired shape of the side walls of the containers being packaged, the contour of the vertical faces 65 of the lugs 41 are accordingly custom made to match. This feature gives a high degree of fine control of the containers during the process. The lugs 41 may, of course, be attached to the chains 13 at any required position along the chains depending on the size (width) and spacing of the individual containers 59.

In accordance with another feature concerning the lugs 41 of the present invention, the straight sides engage the tapered sides of the openings 51. This assures a firm snugging of the carrier 53 around the product without causing undue concern of overtightening the carrier. When the design limit of tightening is reached, the lower edges of the lugs slightly indent the sides of the opening and no further tightening can occur.

The enlarged upper portion of the openings 51 provided by the tapered shape (see FIG. 5), allows the lugs 41 to freely enter and exit without hanging on the carrier. As can best be visualized in FIG. 5, the lugs 41 sweep in and down at the entrance 7 so that contoured vertical face 65 just clears the side of the enlarged upper portion of the mating opening 51. Similarly, at the exit end (FIG. 2), the lugs may be withdrawn upwardly and outwardly without hanging on the carrier because of the enlarged upper portion of the openings 51.

In summary, it is apparent that the apparatus of the present invention operates to rapidly and efficiently tighten and secure a wraparound carrier 53 about a plurality of containers 59 in a smooth and continuous manner. The carrier 53 is drawn down and secured about the containers 59 while moving along a conveyor line. The draw-down lugs 41 not only serve to tighten the carrier 53 about the containers but also to positively locate and position the containers relative to one another and to the carrier. Positive location of the containers within the carrier is important since, if containers contact one another or if a container is too close to the open ends of the wraparound carrier, the containers may be damaged during subsequent shipping or storage.

While the present invention has been described in considerable detail, it is understood that various changes and modifications would occur to one of ordinary skill in the art without departing from the spirit and scope of the appended claims.

What is claimed is:

1. Apparatus for applying a wraparound carrier to a plurality of containers or the like, said carrier being initially partially wrapped around said containers, said carrier including at least two opposed openings formed on opposite sides thereof, comprising:

means for conveying said carrier and said containers;

a plurality of lug means, pivotally attached to and spaced apart along said conveyor means, said lug means including tongue portions adapted for insertion into said openings formed in said carrier; and means for pivoting said lug means into contact with said carrier openings, whereby said carrier is tightened and secured about said containers by said pivoting lug means while being conveyed;

said tongue portions of said lug means extending through said carrier openings sufficiently to separate and position said containers within said carrier.

2. The apparatus of claim 1 wherein said conveying means comprises a pair of movable members disposed on opposite sides of said carrier and mounting said lug means.

3. The apparatus of claim 1 wherein said tongue portion of said lug means includes vertical faces adapted to fit between and mate with said containers disposed in said carriers.

4. The apparatus of claim 1 wherein said pivoting means comprises a pair of camming rails disposed adjacent said conveyor means, said camming rails cooperating with said lug means to pivot said lug means downwardly when said lug means are carried past said camming rails by said conveyor means.

5. Apparatus for tightening and securing a wrap-around carrier around a plurality of containers or the like, said carrier being initially partially wrapped about said containers to form a container carrier assembly, said carrier including means for securing said carrier together when tightened, said carrier further including at least two openings formed on opposite side walls thereof, said openings disposed substantially between said containers, comprising:

means for guiding said partially wrapped container carrier assemblies;

a pair of movable members arranged on opposite sides of said guide means for conveying said carrier and said containers;

a plurality of lugs, pivotally attached to and spaced apart along said movable members, said lugs including a tongue portion adapted for insertion into said openings formed on said carrier, said tongue portion including vertical faces adapted to fit between said containers; and means for sequentially pivoting opposite pairs of said lugs downwardly into contact with said carrier openings to apply a steady downward pressure thereto, whereby said carrier is tightened and secured about said containers by said pivoting lugs while being conveyed, said tongue portions of said lugs extending through said carrier openings and said vertical tongue faces contacting said containers to control and position said containers within said carrier.

6. The apparatus of claim 5 wherein said pivoting means comprises a pair of linear cams, disposed adjacent said movable member.

7. The apparatus of claim 5 further including means for sequentially pivoting said lugs upwardly out of contact with said carrier apertures after said carrier is tightened and secured about said containers.

8. The apparatus of claim 7 wherein said lug pivoting means comprises compression springs disposed between said movable member and said lug for normally biasing said lugs in a vertical position with respect to said carrier side walls.

9. The apparatus of claim 5 wherein said guide means comprises a guide track disposed adjacent to and below said movable member for guiding a plurality of carrier and container assemblies into, through, and out of contact with said lugs on said movable member.

10. The apparatus of claim 9 further including pusher arms mounted to said movable member for spacing said plurality of carrier and container assemblies apart and accurately aligning said openings of said carriers with said pivoting lugs when said carrier enters between said movable belts.

11. The apparatus of claim 5 wherein each said movable member comprises a continuous chain.

12. The apparatus of claim 5 wherein the number of pairs of carrier draw-down lugs is one less than the number of containers disposed in a row in said carrier.

13. The apparatus of claim 5 wherein said lugs include straight sides and the openings in said carrier include mating tapered sides whereby, said lugs engage said tapered sides and cause tightening of said carrier without overtightening.

14. The apparatus of claim 5 wherein said lugs include straight sides and the openings in said carrier include mating tapered sides, the upper portion of said opening in said carrier being sufficiently wide to avoid hanging on said lugs during insertion and withdrawal of said lugs.

* * * * *